US007017669B2

(12) United States Patent
Johnston et al.

(10) Patent No.: US 7,017,669 B2
(45) Date of Patent: Mar. 28, 2006

(54) METHODS AND APPARATUS FOR EXPANDING TUBULARS

(75) Inventors: Gary Johnston, Balmedie (GB); Ian McDonald Cameron, Aberdeen (GB); David John Hillis, Balmedie (GB)

(73) Assignee: Weatherford/Lamb, Inc., Houston, TX (US)

( * ) Notice: Subject to any disclaimer, the term of this patent is extended or adjusted under 35 U.S.C. 154(b) by 47 days.

(21) Appl. No.: 10/372,629

(22) Filed: Feb. 21, 2003

(65) Prior Publication Data

US 2003/0205386 A1 Nov. 6, 2003

Related U.S. Application Data

(60) Provisional application No. 60/380,064, filed on May 6, 2002.

(51) Int. Cl.
*E21B 43/10* (2006.01)

(52) U.S. Cl. ..... 166/382; 166/207; 166/384

(58) Field of Classification Search ..... 166/382–384, 166/206–208, 242.1, 227, 236; 138/129, 138/135; 73/58, 370.06, 370.07; 405/184.3, 405/259.3; 72/58, 370.06, 370.07
See application file for complete search history.

(56) References Cited

U.S. PATENT DOCUMENTS

| | | | | |
|---|---|---|---|---|
| 341,327 | A * | 5/1886 | Fay | 166/207 |
| 2,670,797 | A * | 3/1954 | Armentrout | 166/136 |
| 2,812,025 | A | 11/1957 | Teague et al. | 166/207 |
| 2,864,450 | A | 12/1958 | Burns | 166/218 |
| 3,627,066 | A * | 12/1971 | Johnson | 175/4.53 |
| 4,696,606 | A * | 9/1987 | Herron | 405/259.3 |
| 5,240,076 | A * | 8/1993 | Cromar et al. | 166/382 |
| 5,335,736 | A * | 8/1994 | Windsor | 175/57 |
| 5,803,176 | A | 9/1998 | Blizzard, Jr. et al. | 166/298 |
| 6,513,600 | B1 | 2/2003 | Ross | 166/387 |
| 6,564,870 | B1 | 5/2003 | Grigsby et al. | 166/313 |
| 6,675,901 | B1 * | 1/2004 | Johnson et al. | 166/380 |
| 6,848,510 | B1 * | 2/2005 | Bixenman et al. | 166/385 |
| 2001/0045289 | A1 | 11/2001 | Cook et al. | |

FOREIGN PATENT DOCUMENTS

| | | |
|---|---|---|
| EP | 0 961 007 | 12/1999 |
| WO | WO 94/18429 | 8/1994 |
| WO | WO 00/37766 | 6/2000 |
| WO | WO 02/25059 | 3/2002 |

OTHER PUBLICATIONS

PCT International Search Report, International Application No. PCT/GB 03/01895, dated Aug. 29, 2003.

* cited by examiner

*Primary Examiner*—Kenneth Thompson
(74) *Attorney, Agent, or Firm*—Patterson & Sheridan, L.L.P.

(57) ABSTRACT

The present invention provides methods and apparatus for expanding a first, smaller diameter tubular into frictional contact with a second, larger diameter tubular or wellbore. In an embodiment, annular formations formed on an inner surface of a split ring engage an outer surface of the smaller tubular. In one aspect, the smaller diameter tubular is provided with an annular recess there around, the annular recess including recessed grooves formed there around. Therefore, the split ring is disposable within the annular recess and the annular formations formed on the split ring are constructed and arranged to fit within the recessed grooves of the annular recess of the tubular. An outer surface of the split ring is provided with teeth or some other grip-enhancing material or formation. The split ring also includes a split portion permitting the ring to expand in diameter as that portion of the tubular is expanded in diameter.

29 Claims, 10 Drawing Sheets

METHODS AND APPARATUS FOR EXPANDING TUBULARS

This application claims benefit of U.S. Provisional No. 60/380,064, filed May 6, 2002.

BACKGROUND OF THE INVENTION

1. Field of the Invention

The present invention generally relates to wellbore tubulars. More particularly, the invention relates to expandable tubulars in a wellbore. More particularly still, the invention relates to apparatus and methods for expanding a first, smaller diameter tubular into frictional contact with a second, larger diameter tubular or wellbore.

2. Description of the Related Art

Operations in a wellbore are typically carried out with a downhole tool mounted at the end of a string of tubulars. Likewise, the transportation of production fluid to a surface of the wellbore is performed using a string of tubulars to form a fluid path. In other instances, tubulars are used to line the wellbore to facilitate the isolation of hydrocarbon bearing formations and support the walls of the wellbore. Therefore, tubulars are strung together to make a long string that can stretch from a lower end of the wellbore to the surface of the wellbore in all these situations.

Recently, expandable tubulars have been introduced that can be enlarged in diameter at a predetermined location in the wellbore. These expandable tubulars have facilitated many wellbore operations and permit a tubular of a smaller diameter to be inserted into the wellbore and subsequently enlarged in-situ. One use for expandable tubulars includes the expansion of a first, smaller diameter tubular into a second, larger diameter tubular to form a seal or frictional relationship there between. The expansion is typically performed using a fluid actuated expander tool which includes one or more radially extendable expanding members which contact the inner wall of the tubular and urge it past its elastic limits. By rotating the expander tool on a work string while the expanding members are actuated, a tubular can be circumferentially expanded into frictional contact with a wellbore or another tubular there around. In this manner, a smaller diameter tubular can be hung in place in a larger diameter tubular without the use of mechanical cones and slips, which utilize valuable real estate in an annular area between tubulars.

There are problems associated with hanging one tubular inside another through expansion. For example, to affect an adequate frictional relationship between the two tubulars, an outer surface of the smaller tubular must be supplied with some type of grip-enhancing material or formations. These formations must be fabricated on the outer surface of the tubular or on a separate sub assembly attached at the top of the tubular, leading to additional expense. Use of these prior art methods has also resulted in inconsistent results, with the tubular sometimes loosing its grip on the wall of the larger tubular due to subsequent operations. Additionally, the provision of hardened formations or buttons to the tubular increases its thickness and makes its expansion more difficult.

Therefore, there exists a need for more effective apparatus and methods of providing an adequate griping surface between a larger tubular and a smaller tubular for expansion into frictional contact with the larger tubular. There is a further need for flexible apparatus and methods for providing grip-enhancing formations on a tubular whereby the formations are easily selected depending upon a particular need.

SUMMARY OF THE INVENTION

The present invention provides methods and apparatus for expanding a first, smaller diameter tubular into frictional contact with a second, larger diameter tubular or wellbore. A split ring is disposable around an outside diameter of the first tubular and has annular formations formed on an inner surface thereof which are constructed and arranged to engage the first tubular. In one aspect, the smaller diameter tubular is provided with an annular recess there around in order to hold the split ring. The annular recess can include recessed grooves formed there around that receive the annular formations of the split ring. In another embodiment, the split ring is initially held axially in position around the first tubular by elastomer bands disposed on either end of the split ring. An outer surface of the split ring is provided with teeth or some other grip-enhancing material or formation. The split ring also includes a split portion permitting the ring to expand in diameter as that portion of the tubular is expanded in diameter.

As the tubular and the split ring are expanded with a compliant-type expander tool, the teeth of the split ring contact and form a frictional relationship with an inner surface of the larger diameter tubular there around, preventing axial and rotational movement between the split ring and the casing wall. Additionally, the annular formations of the split ring can engage an outer surface of the smaller tubular in order to prevent axial movement between the split ring and the smaller tubular. As the tubular is expanded in the area of the split portion, the tubular forms an undulation extending partially through an open area or split portion of the split ring. The undulation effectively prevents rotational movement between the split ring and the expanded tubular. In one aspect of the invention, the apparatus includes elastomeric seal rings disposed at an upper end of the split ring and at a lower end of the split ring to provide a seal between the smaller diameter inner tubular and the larger diameter outer tubular once the inner tubular expands into contact with the outer tubular.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
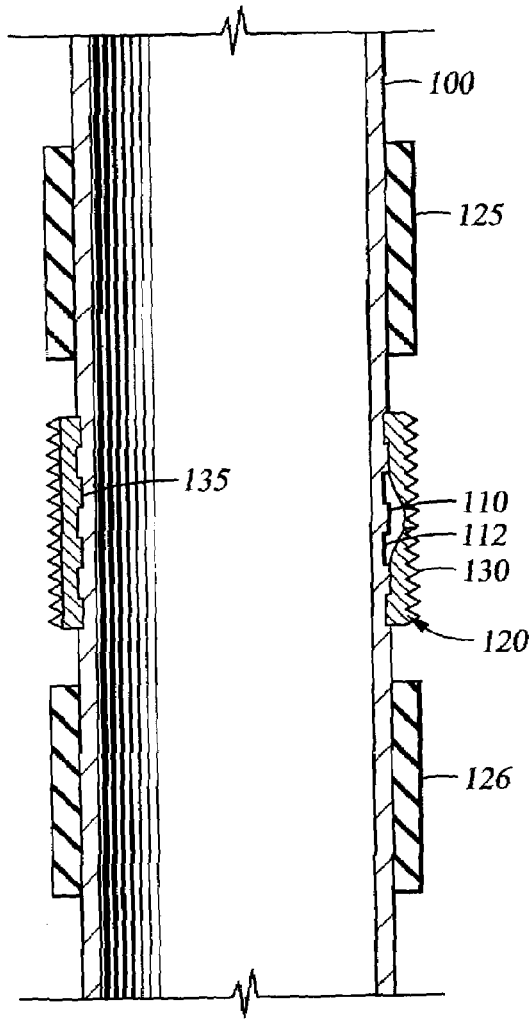
FIG. 1 is a section view of a tubular with a split ring and two seal rings disposed there upon.

The present invention relates to expansion of a first smaller diameter tubular into a second larger diameter tubular wellbore therearound. FIG. 1 is a section view of a tubular 100 having an annular recess 110 formed there upon with a split ring 120 disposed in the annular recess. In this specification, the term "split ring" refers to any independent, annular member that forms an interface between an outer surface of a smaller tubular and an inner surface of a larger tubular or wellbore. The tubular also includes two seal rings 125, 126, one disposed above the split ring 120 and one disposed below the split ring, for sealing an annular area between the tubular 100 and a coaxially disposed tubular having a greater diameter (not shown). As illustrated in FIG. 1, the seal rings 125, 126 are typically made of an elastomeric material, that deforms somewhat to effect a seal between another surface when expanded into contact therewith. The split ring 120 includes grip-enhancing formations formed on an outer surface thereof, which, in the embodiment shown in FIG. 1 are teeth 130. The teeth 130 are constructed and arranged to come into frictional contact with the greater diameter tubular coaxially disposed around the tubular 100. As shown, the teeth 130 can be bi-directional in order to substantially prevent axial movement in either direction once the frictional contact is established. On an inner surface of the split ring 120 are annular formations 135, which are designed to mate with recessed grooves 112 formed within the annular recess 110 of the tubular 100. When the split ring 120 is disposed within the annular recess 110, the split ring 120 is prevented from axial movement in relation to the tubular 100.

Figure 2:
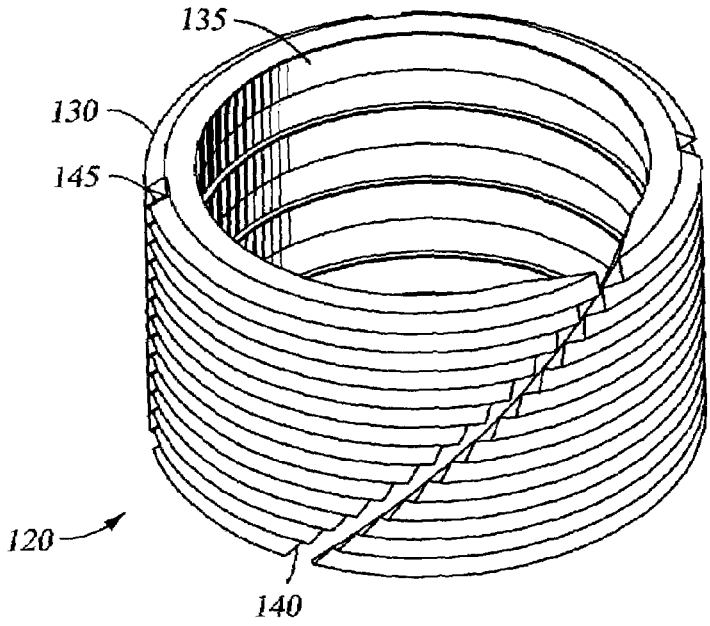
FIG. 2 is a perspective view of the split ring of FIG. 1.

FIG. 2 is a perspective view of the split ring 120 shown in FIG. 1. As illustrated, the split ring 120 is an annular member having teeth 130 formed on the outer surface thereof. Visible also in FIG. 2 is a split portion 140 of the ring 120, which in the embodiment shown runs at about a 30° angle from the vertical. In the embodiment shown, the split portion 140 is angled from the vertical to minimize jolting caused by a roller of an expander passing over the split portion as will be more completely explained herein. The split portion 140 is constructed and arranged to open and/or become enlarged as the tubular 100 and the split ring 120 are expanded. Also formed longitudinally in the outer surface of the split ring 120 are longitudinal grooves 145 designed to increase the gripping effect of the split ring 120 as it contacts a tubular therearound (not shown). Visible in the interior of the split ring in FIG. 2 are the annular formations 135 formed on an under side of the split ring and constructed and arranged to mate with the recess grooves 112 of the annular recess 110 in the tubular 100 as shown in FIG. 1. In a preferred embodiment, the split ring 120 is constructed of a material harder than a material of the tubular that it contacts when expanded. For example, the material of the teeth 130 can be harder than the surface of a casing (not shown) that the split ring 120 contacts when expanded. This relative hardness of the teeth 130 ensures that they engage and preferably deform the casing wall somewhat upon contact therewith.

Figure 3:
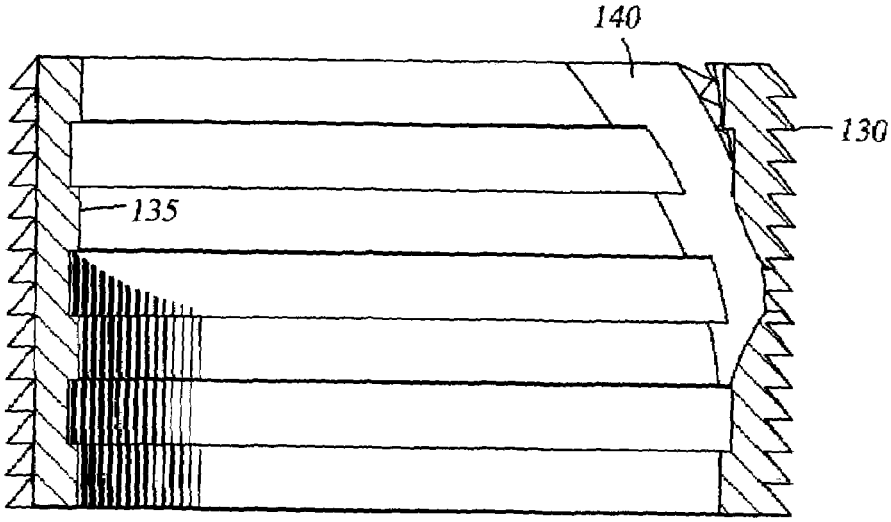
FIG. 3 is a section view of the split ring.

FIG. 3 is a section view of the split ring 120 illustrating the split portion 140 of the split ring visible on the right side of the figure and the annular formations 135 on the inside of the split ring 120. As shown, the teeth 130 can alternatively be unidirectional based upon a shape and angle of protrusion from the split ring 120. In this manner, the teeth 130 can provide more resistance to an axial movement in a first direction than an axial movement in a second direction once the teeth 130 engage the greater diameter tubular.

Figure 4:
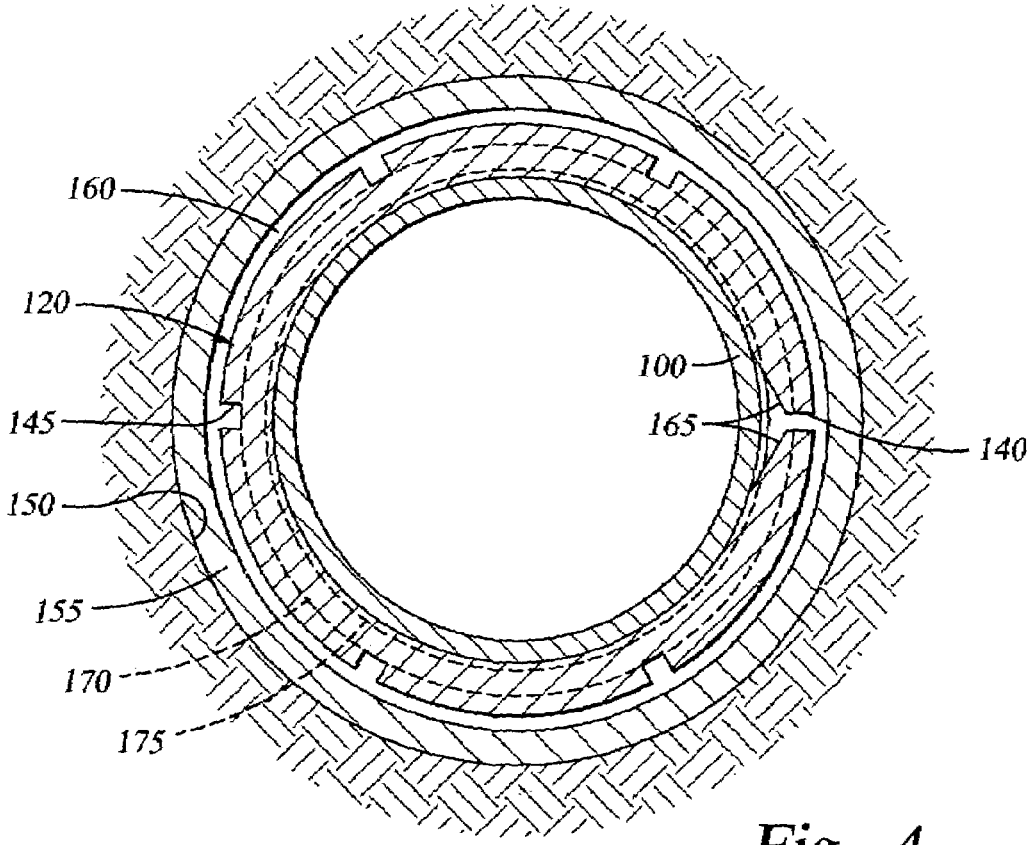
FIG. 4 is a top section view of a wellbore, a larger diameter tubular lining the wellbore, and a split ring disposed around a smaller diameter tubular.

FIG. 4 is a top section view of a wellbore 150, which is lined with casing 155. Disposed within the wellbore 150, coaxially with the casing 155 is the tubular 100 and the split ring 120 disposed around the tubular 100. An annular area 160 is initially formed between an outer surface of the split ring 120 and an inner surface of the casing 155. Visible in the figure are the longitudinal grooves 145 extending from an upper to a lower end of the split ring as well as the split portion 140 of the split ring 120. Visible specifically are tapered surfaces 165 on an inside of the split ring 120 in the area of the split portion 140. These tapered surfaces 165 facilitate an undulation of the tubular 100 in the area of the split portion 140 upon expansion of the tubular 100 (see FIG. 7). Visible as a dashed line 170 are lower surfaces or inside surfaces of each tooth formed on the outer surface of the split ring 120. Since annular formations 135 (see FIG. 1) are disposed within the recessed grooves 112 of the tubular 100, dashed line 175 illustrates an inside diameter of a portion of the split ring 120 that lacks the annular formations thereby permitting the annular recess 110 of the tubular 100 to contact the split ring at dashed line 175.

Figure 5:
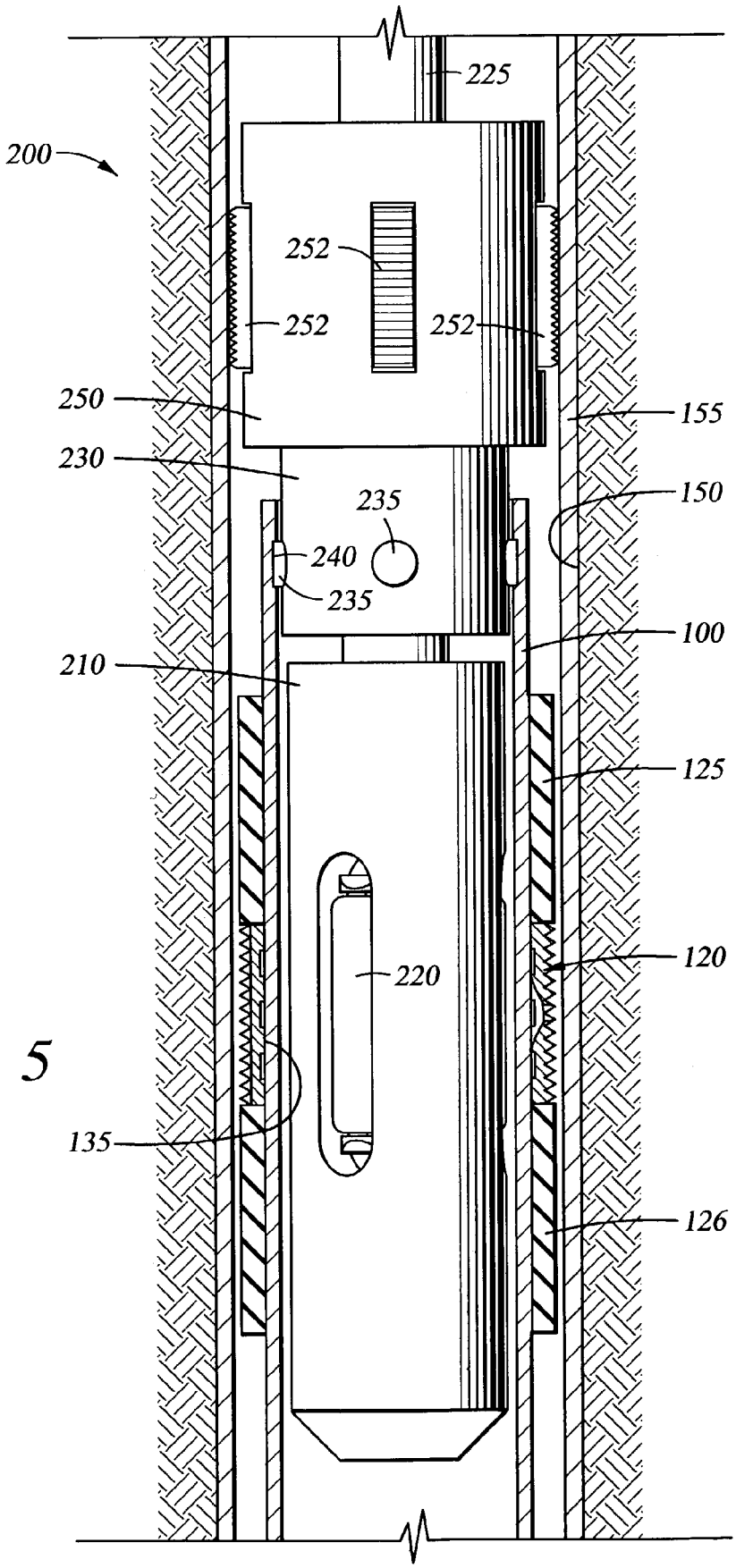
FIG. 5 is a partial section view of a wellbore with an expander tool, a locking assembly there above, and a torque anchor above the locking assembly.

FIG. 5 is a partial section view of the wellbore 150 showing a deployment apparatus 200 that includes the tubular 100, the split ring 120 disposed around the tubular and the seals 125, 126 disposed on the tubular at either end of the split ring. In an embodiment shown in FIG. 5, the outside diameter of the tubular 100 is substantially uniform and does not comprise the annular recess with grooves as shown in FIG. 1. Therefore, the annular formations 135 on the inner surface of the split ring 120 engage an outer surface of the tubular 100 upon expansion. This prevents thinning of the tubular's wall due to having a preformed recess on the outer diameter of the tubular 100, which can create a weak point in the tubular. In this embodiment, elastomer rings such as the seal rings 125, 126 positioned proximate each end of the split ring 120 maintain an axial position of the split ring on the tubular 100 prior to its expansion.

The deployment apparatus 200 shown in FIG. 5 includes an expander tool 210 which, as previously described includes radially disposed expansion members 220 that outwardly actuate to contact and expand the tubular 100 past its elastic limits and to place the seal rings 125, 126 and the teeth of the split ring 120 into frictional contact with a wall of the casing 155. This also engages the annular formations 135 with the tubular 100 to provide frictional contact between the tubular 100 and the split ring 120. The expander tool 210 is operated with pressurized fluid provided from a work string 225 upon which it is disposed. A locking assembly 230 disposed above the expander tool includes dogs 235, which are initially disposed within preformed profiles 240 at an upper end of the tubular 100. In this manner, the tubular is initially retained by the dogs 235 of the locking assembly 230 prior to being expanded into contact with the casing 155. Disposed above the locking assembly is a torque anchor 250, which temporarily fixes the apparatus 200 rotationally with respect to the casing 155. As shown in FIG. 5, radially extendable buttons 252 are in contact with the casing and effectively prevent rotation of the tubular 100, but permit rotation of the expander tool 210 therein. In operation, the deployment apparatus 200 with the torque anchor 250, locking assembly 230, tubular 100, and split ring 120 are run into the wellbore 150 to a predetermined location where the tubular 100 will be expanded and hung in the wellbore casing 155.

Figure 6:
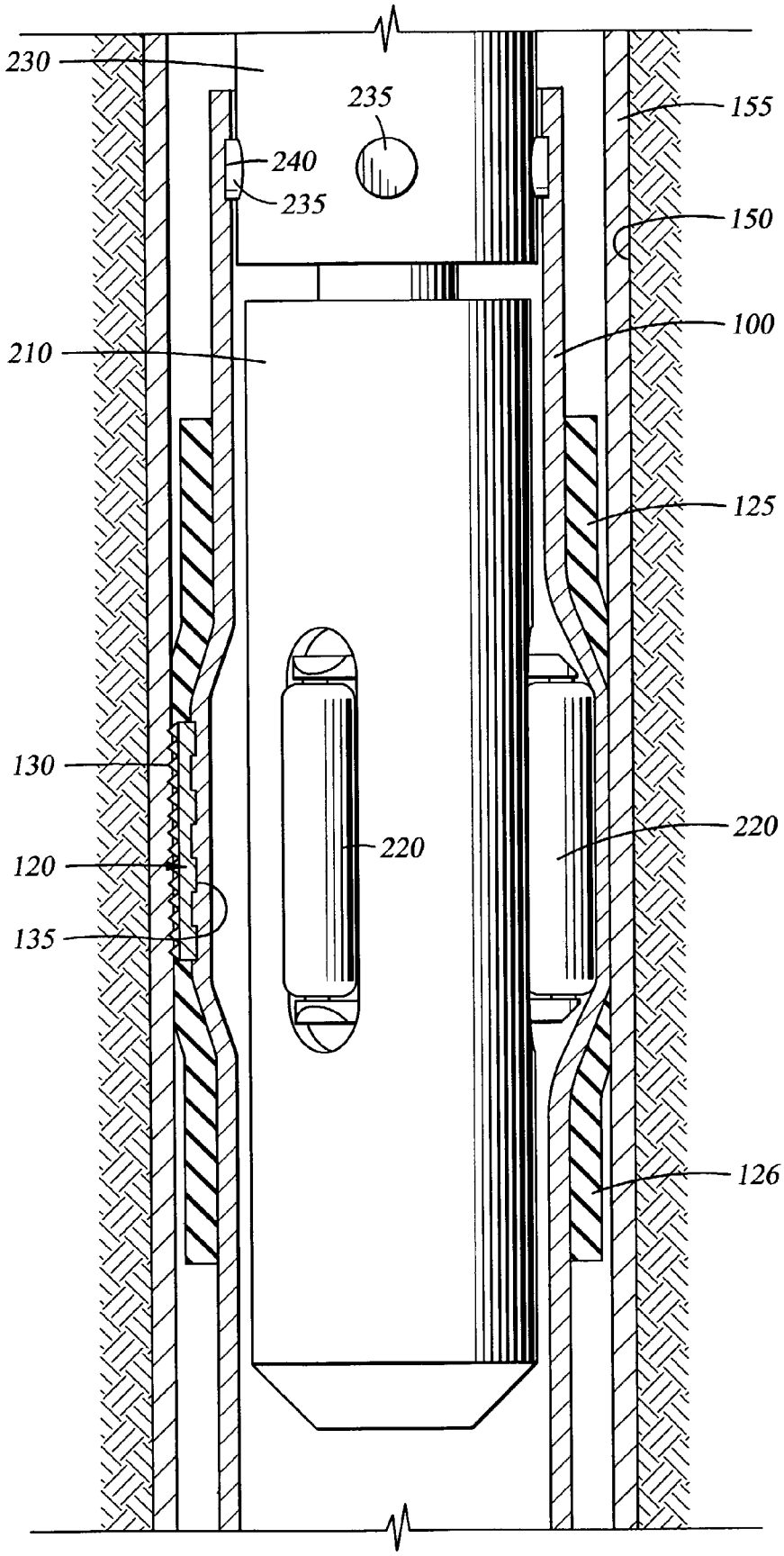
FIG. 6 is a partial section view of the apparatus of FIG. 5 illustrating the split ring having been expanded into frictional contact with the outer tubular.

FIG. 6 is a partial section view of the wellbore 150 illustrating the apparatus 200 of FIG. 5 after the expander tool 210 has been actuated and rotated in order to expand the tubular 100 past its elastic limits and place the teeth 130 formed on the outer surface of the split ring 120 into frictional contact with the wall of the casing 155. At the same time, the annular formations 135 on the split ring 120 engage the tubular 100. Preferably, the annular formations 135 at least partially deform the wall of the tubular 100, and the annular formations can embed into or penetrate the metal forming the wall of the tubular. Once the annular formations 135 engage the tubular 100, the split ring 120 is prevented from axial movement in relation to the tubular 100. In FIG. 6, the weight of the tubular 100 is supported by the frictional relationship between the casing 155 and the teeth 130 of the split ring 120 due to the annular formations 135 of the split ring 120 having engaged the wall of the tubular 100.

Figure 7:
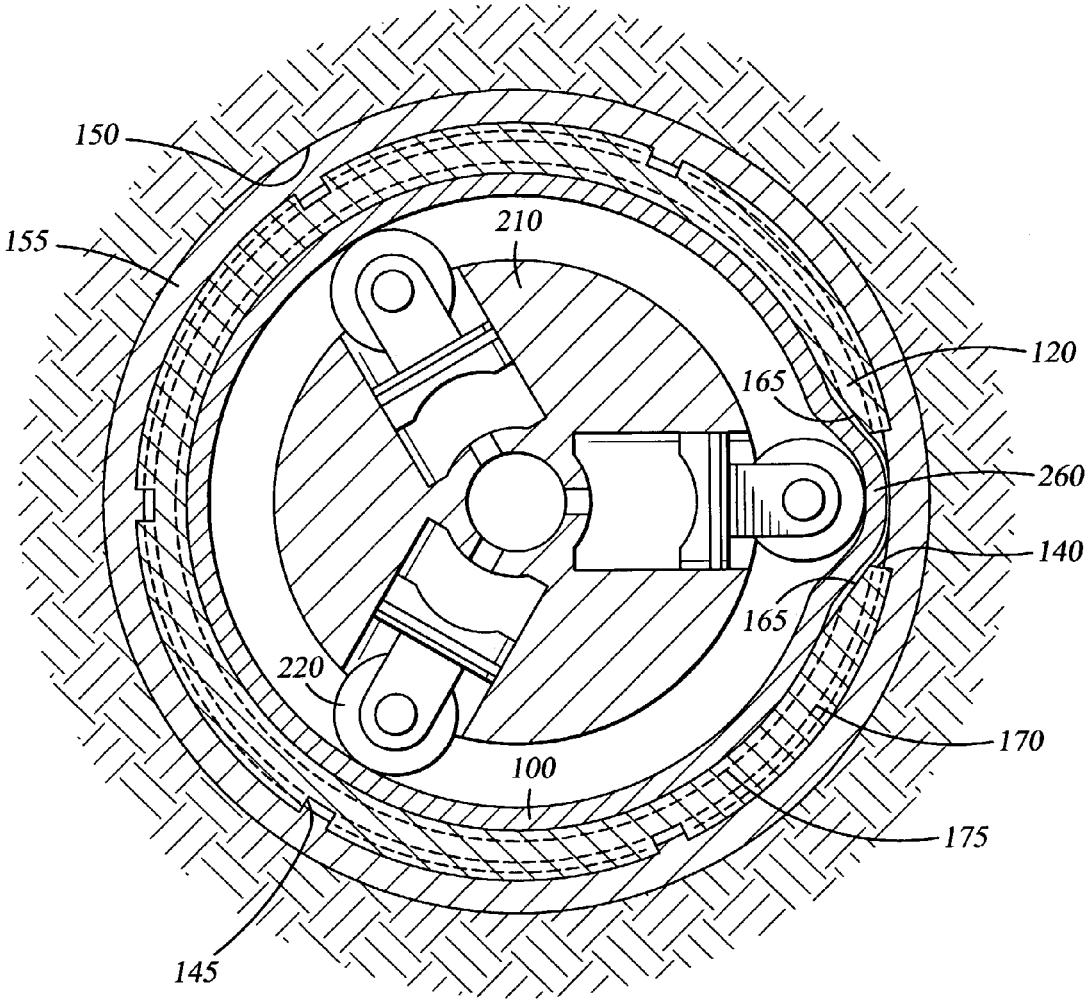
FIG. 7 is a top section view illustrating expansion members of the expander tool actuated and having caused the smaller tubular to form an undulation in the area of a split portion of the split ring.

FIG. 7 is a top section view of the wellbore 150 showing the expander tool 210 having expanded the tubular 100 past its elastic limits and placed the teeth (not shown) of the split ring 120 into frictional contact with the wall of the casing 155. Since the outside diameter of the tubular 100 does not have an annular recess or groove and the dashed line 175 illustrates the inside diameter of the portion of the split ring 120 where there are no annular formations present, the outside diameter of the tubular 100 can deform to contact dashed line 175 when expanded and engaged with the split ring 120. Visible specifically in FIG. 7 are the longitudinal grooves 145 formed in the outer surface of the split ring 120 and their effect in retaining the split ring within the casing 155. Also visible is an undulation 260 within the diameter of tubular 100 that is formed as the tubular 100 expands in the area of the enlarged split portion 140 of the split ring 120. Because the expander tool 210 operates compliantly and each expansion member 220 is independently extendable, the undulation 260 is formed in the area of the enlarged split portion of the split ring 120. This arrangement effectively keys the tubular 100 to the split ring 120 and prevents rotation of the tubular at a later time. Therefore, the undulation 260 facilitates additional expansion of the tubular 100 by preventing rotational movement of the tubular as the expander tool 210 rotates within the tubular. As previously mentioned, the angle of the split portion 140 from the vertical facilitates a smooth movement of the roller or expansion member 220 across the split portion 140 of the split ring 120.

Figure 8:
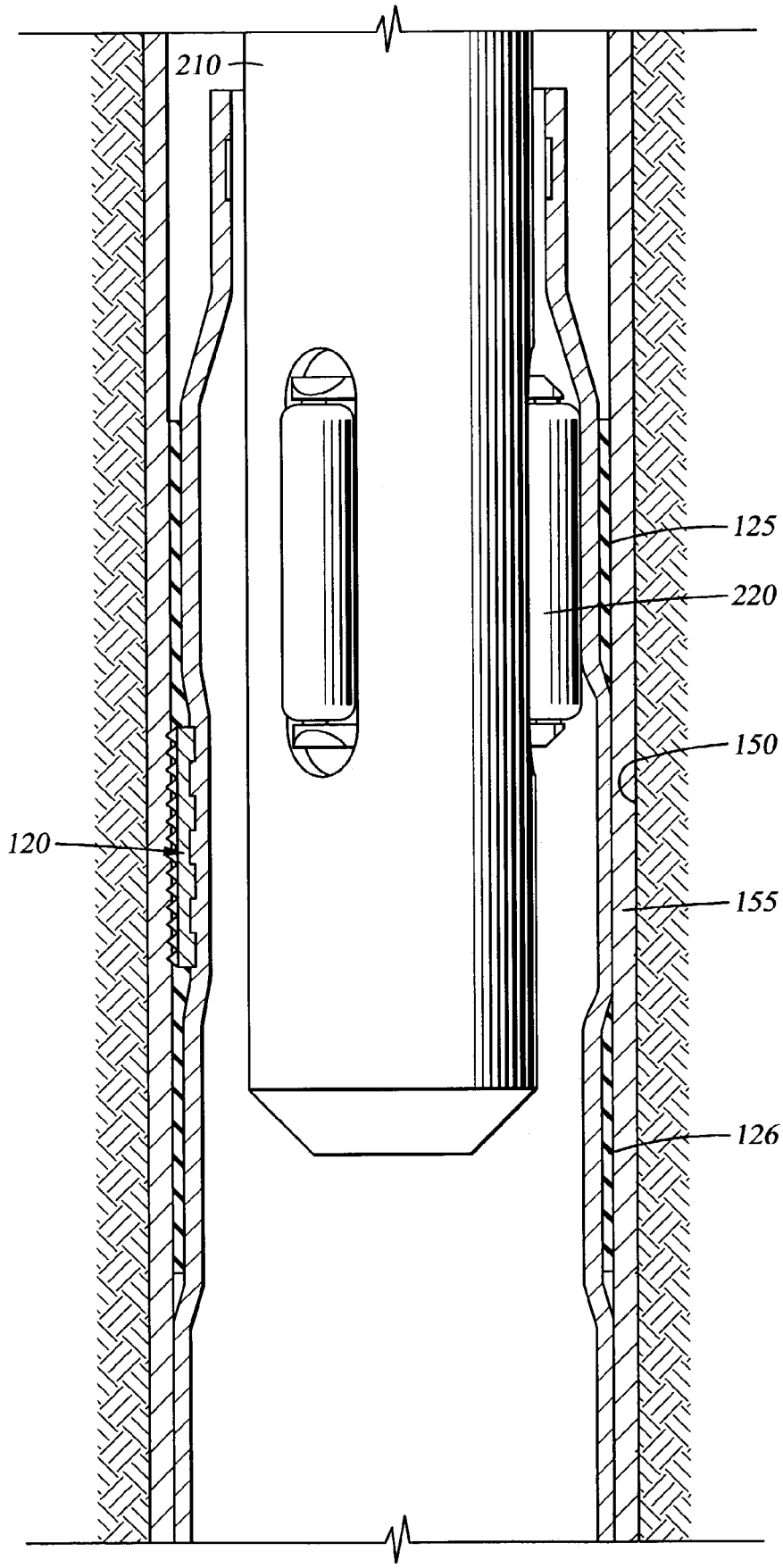
FIG. 8 is a partial section view showing the smaller diameter tubular as well as the seals expanded into contact with the larger diameter tubular by the expander tool.

FIG. 8 illustrates the expansion tool 210 being translated axially within the wellbore 150 to expand the tubular 100 in the area of the elastomeric seals 125, 126. In practice, the expander tool would be translated axially after the tubular 100 is successfully hung in the wellbore and the weight of the tubing string is born by the casing 155 at the location of the split ring 120. While a compliant type expander tool is shown in the Figures, the invention could be equally useful with a non-compliant expander, like a core.

Figure 9:
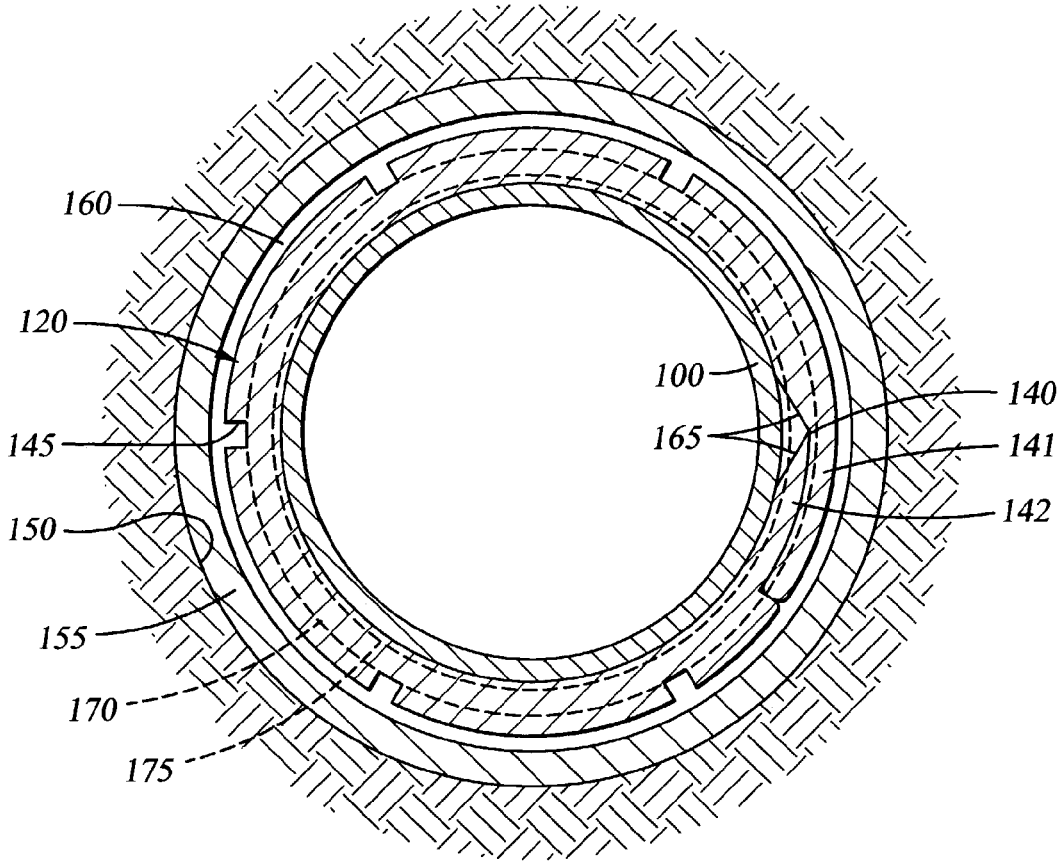
FIG. 9 is a top section view of a wellbore, a larger diameter tubular lining the wellbore, and another embodiment of a split ring disposed around a smaller diameter tubular.
Figure 10:
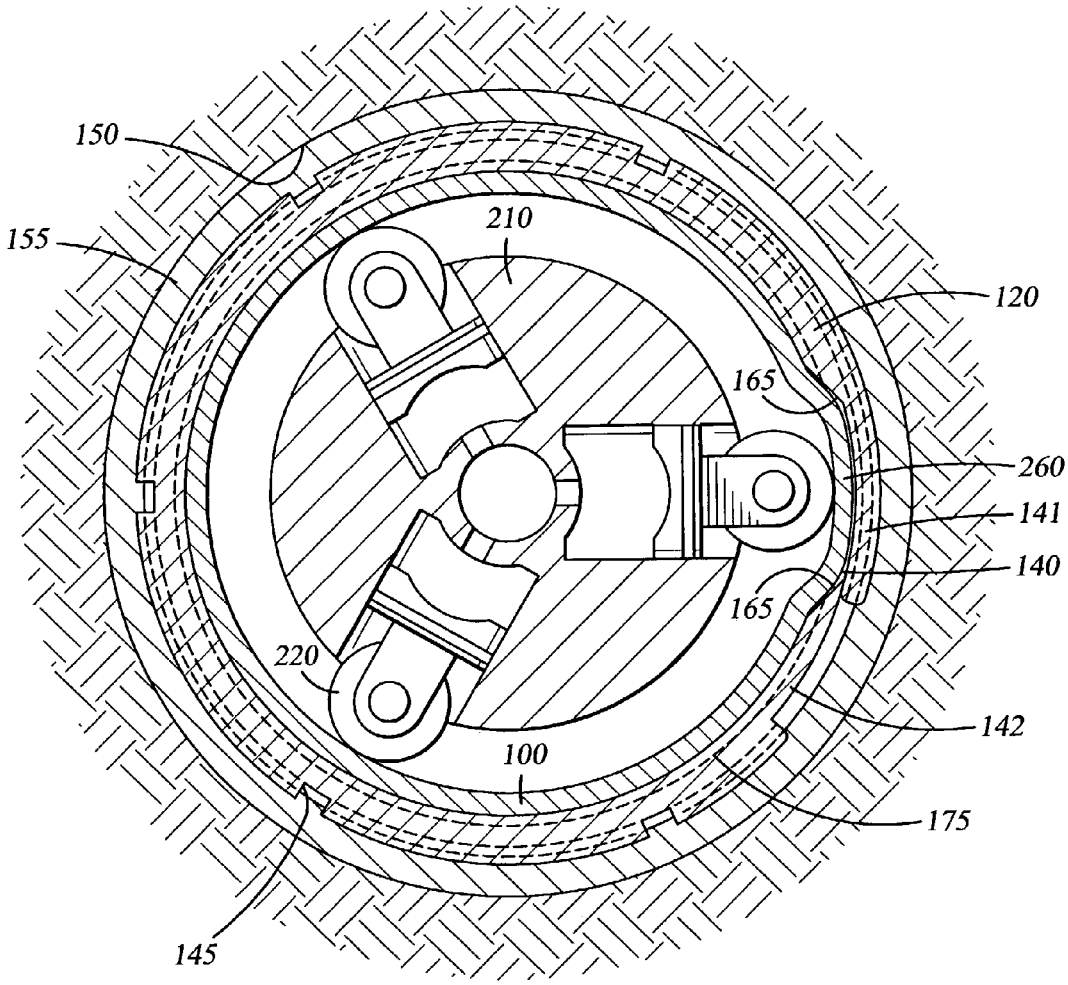
FIG. 10 is a top section view illustrating expansion members of an expander tool actuated and having caused the smaller tubular to form an undulation in the area of a split portion of the split ring shown in FIG. 9.

FIG. 9 illustrates another embodiment of a split ring 120 having an outer portion 141 of the split ring that overlaps an inner portion 142 of the split ring at a split portion 140. Tapered surfaces 165 facilitate forming of an undulation 260 of a tubular 100 in the area of the split portion 140 upon expansion of the tubular 100 as shown in FIG. 10. As visible in FIG. 10, the expanded split ring 120 provides three hundred and sixty degree coverage around the tubular 100. Since the tubular 100 can thin at the undulation 260, the outer portion 141 of the split ring 120 limits expansion of the tubular 100 when forming the undulation 260.

Figure 11:
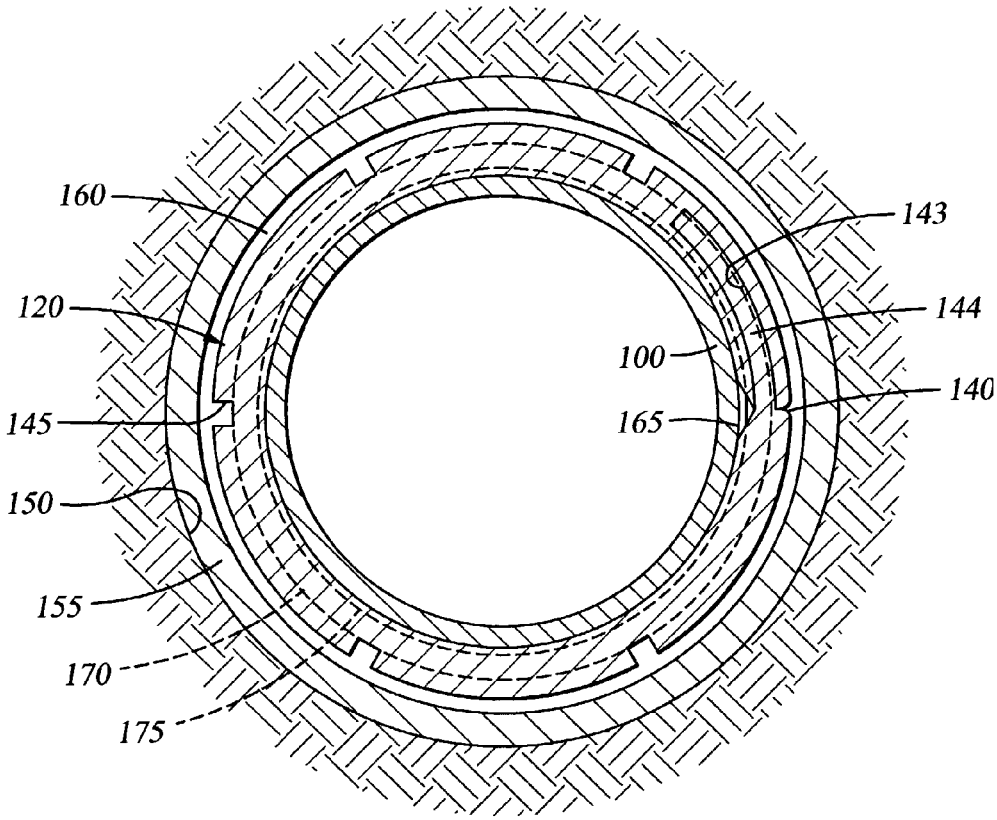
FIG. 11 is a top section view of a wellbore, a larger diameter tubular lining the wellbore, and another embodiment of a split ring disposed around a smaller diameter tubular.
Figure 12:
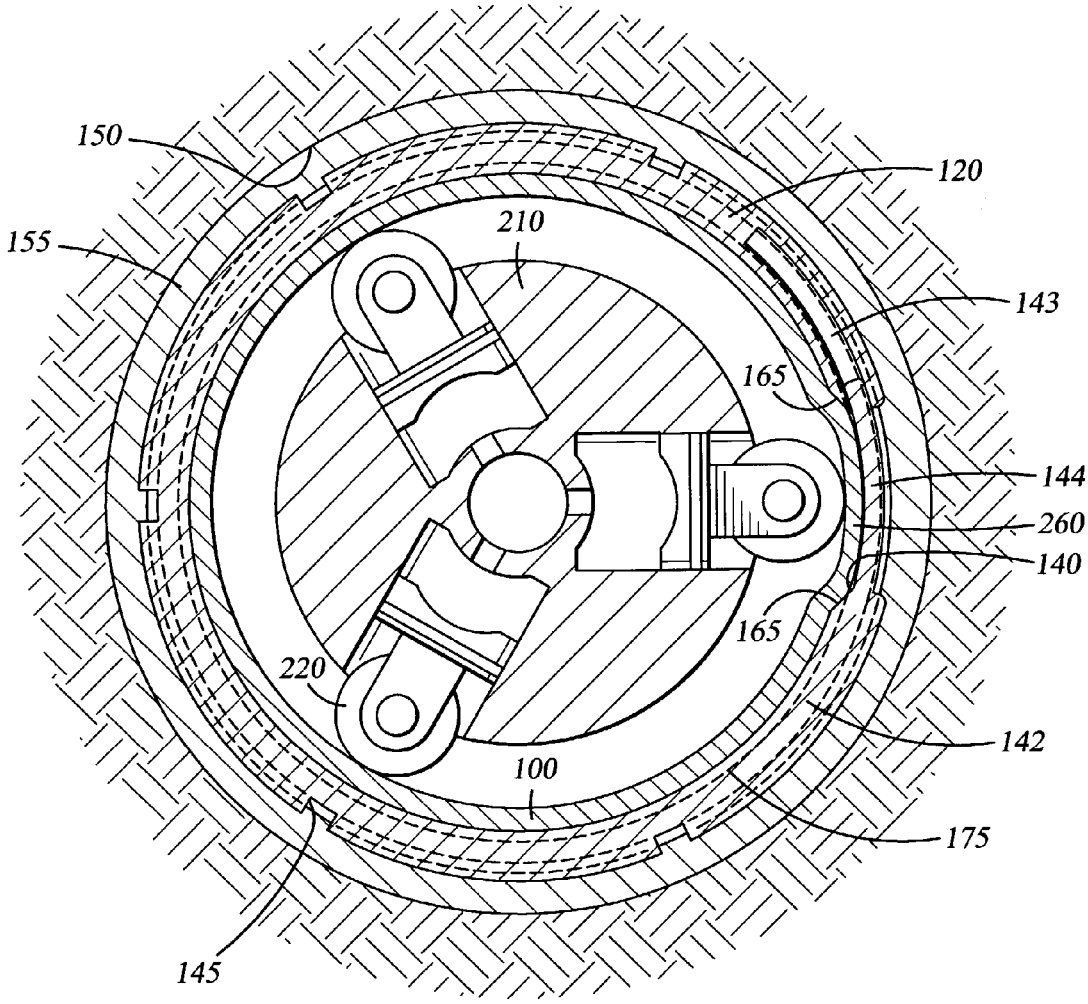
FIG. 12 is a top section view illustrating expansion members of an expander tool actuated and having caused the smaller tubular to form an undulation in the area of a split portion of the split ring shown in FIG. 11.

FIG. 11 illustrates another embodiment of a split ring 120 having a slot 143 extending into the split ring on one side of the split portion 140 that receives a profile 144 formed in the split ring on an opposite side of the split portion 140. Tapered surfaces 165 facilitate an undulation of a tubular 100 in the area of the split portion 140 upon expansion of the tubular 100 as shown in FIG. 12. Similar to the embodiment shown in FIG. 9 and FIG. 10, the split ring 120 when expanded provides three hundred and sixty degree coverage around the tubular 100 and limits expansion of the tubular 100 at the undulation 260 due to the tubular 100 contacting the profile 144.

While the split portion 140 is formed at an angle in the embodiments shown, it can be formed vertically and the resulting undulation in the tubing can be used as a loading profile or other locating means at a later time.

While a single split ring is shown in the Figures, it will be understood that the invention contemplates the use of multiple split rings in order to enhance the advantages brought about by a single split ring. For example, multiple rings could be stacked one on top of another to simulate a single ring with formations formed on its under surface. Additionally, the split portion of the ring can include any shape so long as it performs the basic junction of providing an interface between two tubulars or a single tubular and a wellbore therearound. For instance, the ring could have a partial split that is constructed and arranged to break open upon expansion. In another possible embodiment, the ring could be made in segments that are initially held together by an elastomer prior to expansion in a wellbore.

In operation the apparatus is used in the wellbore as follows: The apparatus 200 including the torque anchor 250, the locking assembly 230, the tubular 100, the split ring 120, and the elastomeric seals 125, 126 as well as the expander tool 210 are run into the wellbore to a predetermined location. Thereafter, the torque anchor 250 is actuated with a first fluid pressure causing the buttons 252 disposed thereon to extend radially into contact with the casing 155, effectively preventing rotational movement of the tubular 100 in relation to the casing 155. Initially, the weight of the tubular 100 is born by dogs 235 formed on the locking assembly 230, which are disposed in a preformed profile 240 in the inner surface of the tubular 100. Upon application of a second, higher fluid pressure the expansion members 220 disposed upon the expander tool 210 actuate and contact an inner surface of the tubular 100. With fluid pressure applied to the expander tool 210 and rotational movement, the walls of the tubular 100 expand past their elastic limit and the teeth formed on the split ring 120 contact the inner walls of the casing 155. A split portion of the split ring 120 enlarges and the compliant expander tool 210 creates an undulation 260 in the tubing 100 in the area of the enlarged split portion 140, thereby rotationally fixing the tubular within the split ring which is itself rotationally and axially fixed to the casing wall. At this point, the expander tool 210 may be reactivated and the seal members 125, 126 placed into contact with the casing 155 through additional expansion of the tubular 100 in the area of the seal members. Thereafter, reducing fluid pressure permits the expansion members 220 to retract into a housing of the expander tool 210 and a further reduction of pressure permits the buttons 252 of the torque anchor 250 to retract. At this point, the assembly 200 is preferably pulled from the surface of the well to insure that there is an adequate frictional relationship between the teeth 130 of the split ring 120 and the wall of the casing 155 to suspend the weight of the tubular 100 in the wellbore 150. The dogs 235 of the locking assembly 230 are then disengaged, typically by dropping a ball into a ball seat (not shown) of the locking assembly 230 and disactuating the dogs with fluid pressure. With the physical connection disengaged between the locking assembly 230 and the tubular 100, the apparatus 200 can be removed from the wellbore 150.

The foregoing apparatus and methods permit effective and simple expansion of a wellbore tubular into a larger diameter tubular there around. In addition to rotationally and axially fixing the smaller tubular within the larger tubular, the split ring provides an additional advantage of becoming rotationally locked within the expanded tubular which becomes rotationally fixed within the split ring.

With the tubular successfully hung in the wellbore, the same or another expander tool can be utilized to enlarge the diameter of the tubular for any axial distance required.

While the invention has been described as utilizing a new continuous split ring, the invention can also be practiced with a continuous ring that is not initially split. In particular, the continuous ring can comprise a weakened portion constructed and arranged to fail at a predetermined outward radial pressure, in effect becoming a split ring prior to engaging an outer tubular.

While the foregoing is directed to embodiments of the present invention, other and further embodiments of the invention may be devised without departing from the basic scope thereof, and the scope thereof is determined by the claims that follow.

What is claimed is:

1. A method of expanding a first tubular in a wellbore, comprising:

running the first tubular into the wellbore, the first tubular having a split ring disposed therearound, wherein the first tubular is run into the wellbore to a location within a second, larger diameter tubular; and expanding a portion of the first tubular past its elastic limits in an area of the split ring, wherein the expanding the portion of the first tubular provides a frictional relationship between grip-enhancing formations on an outside diameter of the split ring and an inside diameter of the second tubular.

2. The method of claim 1, wherein the expanding the portion of the first tubular forms an undulation in a diameter of the first tubular that corresponds to at least a portion of a split portion of the split ring.

3. The method of claim 1, wherein the expanding the portion of the first tubular engages longitudinal grooves on an outer surface of the split ring with the second tubular.

4. The method of claim 1, wherein the expanding the portion of the first tubular engages the first tubular with annular formations on an inside diameter of the split ring.

5. The method of claim 1, wherein the expanding the portion of the first tubular places at least one seal ring disposed around the first tubular into contact with the second tubular.

6. The method of claim 1, wherein the split ring comprises a metal harder than a metal of the second tubular.

7. The method of claim 1, wherein the first tubular has an annular recess around an outside diameter of the first tubular that receives the split ring.

8. The method of claim 1, wherein the first tubular has grooves within an annular recess around an outside diameter of the first tubular that receive annular formations on an inside diameter of the split ring.

9. An apparatus for rotationally and axially supporting wellbore tubulars, comprising:

a first tubular capable of expanding and plastically deforming into contact with an inside diameter of a second tubular, wherein the first tubular has a continuous circumference; and a split ring for disposal around an outer surface of the first tubular, the split ring having grip-enhancing formations on an outer surface thereof.

10. The apparatus of claim 9, wherein the split ring further includes annular formations on an inner surface thereof.

11. The apparatus of claim 9, wherein the grip-enhancing formations comprise teeth.

12. The apparatus of claim 9, wherein the grip-enhancing formations comprise uni-directional teeth.

13. The apparatus of claim 9, wherein the grip-enhancing formations comprise longitudinal grooves.

14. The apparatus of claim 9, further comprising elastomer rings disposed around the outer surface of the first tubular adjacent to the split ring that initially prevent axial movement of the split ring relative to the first tubular.

15. The apparatus of claim 9, further comprising at least one seal ring disposed around the outer surface of the first tubular in order to seal an annular area between the first tubular and the second tubular.

16. The apparatus of claim 9, wherein the split ring comprises a metal harder than a metal of the second tubular.

17. The apparatus of claim 9, wherein the grip-enhancing formations comprise a metal harder than a metal of the second tubular.

18. The apparatus of claim 10, wherein the annular formations of the split ring are constructed and arranged to mate with grooves formed in the first tubular.

19. The apparatus of claim 10, wherein the first tubular has an annular recess around an outside diameter of the first tubular that receives the split ring.

20. The apparatus of claim 10, wherein the annular formations of the split ring are constructed and arranged to engage the first tubular.

21. The apparatus of claim 9, wherein a split portion of the split ring comprises a slot in the split ring adapted to receive a profile in the split ring.

22. A method of expanding a first tubular of a smaller diameter into a second tubular of a larger diameter, comprising:

inserting an apparatus into a wellbore on a run in string of tubulars, the apparatus comprising:

a torque anchor rotationally disposed on the run in string, the torque anchor for rotationally fixing the apparatus with respect to the second tubular;

a locking device deposed in the run in string for selectively retaining the weight of the first tubular;

a split ring having grip-enhancing formations on an outer surface thereof; and an expander tool having at least one radially extendable, compliant expansion member;

activating the torque anchor to rotationally fix the apparatus with respect to the second tubular;

activating the expander tool to expand the first tubular and the split ring through rotational movement of the expander tool in relation to the first tubular;

releasing the torque anchor;

releasing the locking device; and removing the apparatus from the wellbore.

23. The method of claim 22, wherein the split ring is positioned around an annular recess formed on an outer surface of the first tubular, the annular recess including grooves formed therein for mating with annular formations formed on an inner surface of the split ring.

24. The method of claim 22, further including:

translating the expander tool exactly in relation to the apparatus to expand a larger portion of the first tubular.

25. A method of expanding a first tubular in a wellbore, comprising:

running the first tubular into the wellbore, the first tubular having a split ring disposed therearound, wherein the first tubular is run into the wellbore to a location within a second, larger diameter tubular; and expanding a portion of the first tubular in an area of the split ring, wherein the expanding the portion of the first tubular forms an undulation in a diameter of the first tubular that corresponds to at least a portion of a split portion of the split ring.

26. A method of expanding a first tubular in a wellbore, comprising:

running the first tubular into the wellbore, the first tubular having a split ring disposed therearound, wherein the first tubular is run into the wellbore to a location within a second, larger diameter tubular; and expanding a portion of the first tubular in an area of the split ring, wherein the expanding the portion of the first tubular engages the first tubular with annular formations on an inside diameter of the split ring.

27. An apparatus for rotationally and axially supporting wellbore tubulars, comprising:

a first tubular capable of expanding and plastically deforming into contact with an inside diameter of a second tubular; and a split ring for disposal around an outer surface of the first tubular, the split ring having grip-enhancing formations on an outer surface thereof, wherein the split ring further includes annular formations on an inner surface thereof.

28. An apparatus for rotationally and axially supporting wellbore tubulars, comprising:

a first tubular capable of expanding and plastically deforming into contact with an inside diameter of a second tubular;

a split ring for disposal around an outer surface of the first tubular, the split ring having grip-enhancing formations on an outer surface thereof; and at least one seal ring disposed around the outer surface of the first tubular in order to seal an annular area between the first tubular and the second tubular.

29. The method of claim 1, wherein the grip-enhancing formations prevent axial movement of the split ring relative to the second tubular in substantially only one direction.

* * * * *